US006669587B2

(12) United States Patent
Kessler

(10) Patent No.: US 6,669,587 B2
(45) Date of Patent: Dec. 30, 2003

(54) PROPELLER ENHANCED TOY FOOTBALL

(75) Inventor: Brian D. Kessler, Los Angeles, CA (US)

(73) Assignee: Maui Toys, Inc., Los Angeles, CA (US)

( * ) Notice: Subject to any disclaimer, the term of this patent is extended or adjusted under 35 U.S.C. 154(b) by 0 days.

(21) Appl. No.: 10/300,759

(22) Filed: Nov. 21, 2002

(65) Prior Publication Data

US 2003/0100391 A1 May 29, 2003

Related U.S. Application Data

(60) Provisional application No. 60/333,155, filed on Nov. 27, 2001.

(51) Int. Cl.[7] ..... A63B 43/00

(52) U.S. Cl. ..... 473/613; 473/570

(58) Field of Search ..... 473/570, 613, 473/615; 446/57, 178

(56) References Cited

U.S. PATENT DOCUMENTS

| | | | | | |
|---|---|---|---|---|---|
| 4,923,196 | A | * | 5/1990 | Rohring | 473/570 |
| RE34,383 | E | * | 9/1993 | Rohring | 473/570 |
| D346,001 | S | | 4/1994 | Stillinger et al. | |
| D361,811 | S | | 8/1995 | Grimm et al. | |
| 5,779,576 | A | * | 7/1998 | Smith et al. | 473/570 |
| 6,010,419 | A | * | 1/2000 | Rappaport et al. | 473/613 |
| D442,655 | S | | 5/2001 | Schneider | |

* cited by examiner

*Primary Examiner*—Steven Wong
(74) *Attorney, Agent, or Firm*—Browdy and Neimark, P.L.L.C.

(57) ABSTRACT

A soft toy football having guiding fins projecting from its back end is enhanced by a motor driven propeller.

7 Claims, 3 Drawing Sheets

12

20
14
18
18

18
18
14
38
20

12
38
18
18
20
10

12
16
38
18
18
20

PROPELLER ENHANCED TOY FOOTBALL

FIELD OF THE INVENTION

The present invention relates to a toy football, and more particularly to a propeller enhanced toy football.

BACKGROUND OF INVENTION

Toy soft foam elastomer footballs are known, and because they are soft and usually of a smaller size than regulation footballs, they are recommended for indoor play or play with or among small children.

Toy footballs or the like with rearwardly projecting fins are also known, e.g. see U.S. Design Pat. Nos. D346,001; D361,811; and D442,655; and U.S. Pat. Nos. 5,284,341; 5,269,514 and 3,225,488. The fins tend to help regulate the flight path of the football to assume a more even and regular flight path after it has been thrown.

SUMMARY OF INVENTION

However, no toy footballs are known which have both fins and a motor driven propeller, the latter of which provides improved stability and aerodynamic properties.

It is therefore an object of the present invention to provide a toy football of the above general type, which provides improved stabilization and/or overcomes deficiencies in the prior art.

The present invention comprises a soft football made of foam plastic or foam rubber or the like, preferably with a skin, having a tubular recess in which resides a battery pack and motor. Attached thereto, and extending from the back end of the football, are a plurality of axially and radially projecting aligned fins and a propeller which is driven by the aforementioned motor. The fins and motor driven propeller cooperate to provide improved stabilization for the football during flight.

DETAILED DESCRIPTION OF EMBODIMENTS

Figure 1:
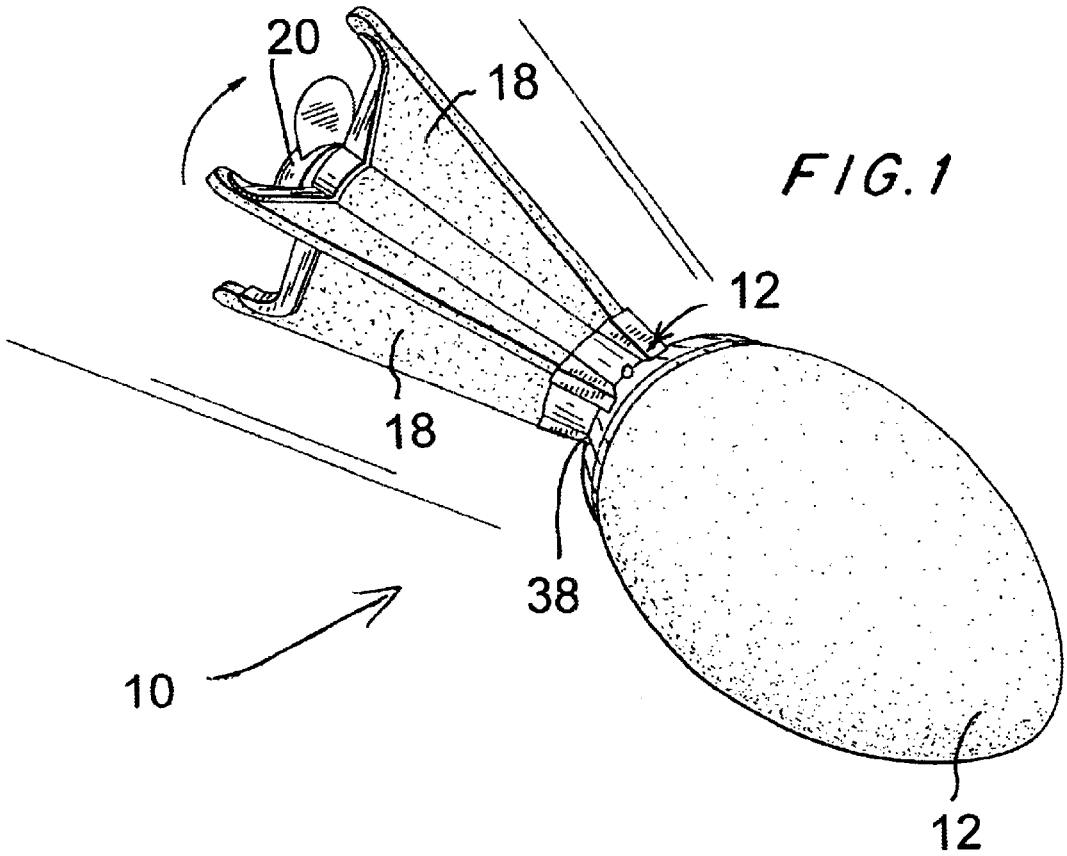
FIG. 1 is a perspective view of a toy football in accordance with the present invention.
Figure 2:
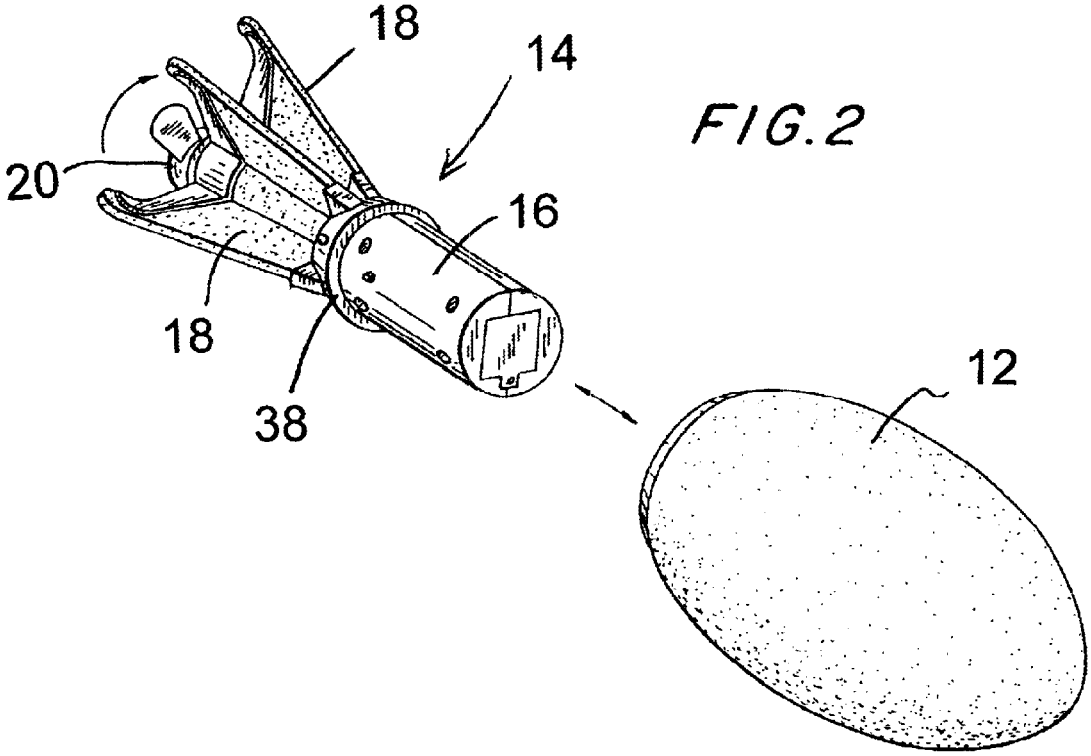
FIG. 2 is a perspective exploded view of the embodiment of FIG. 1.
Figures 3, 4, 5, 6, 7:
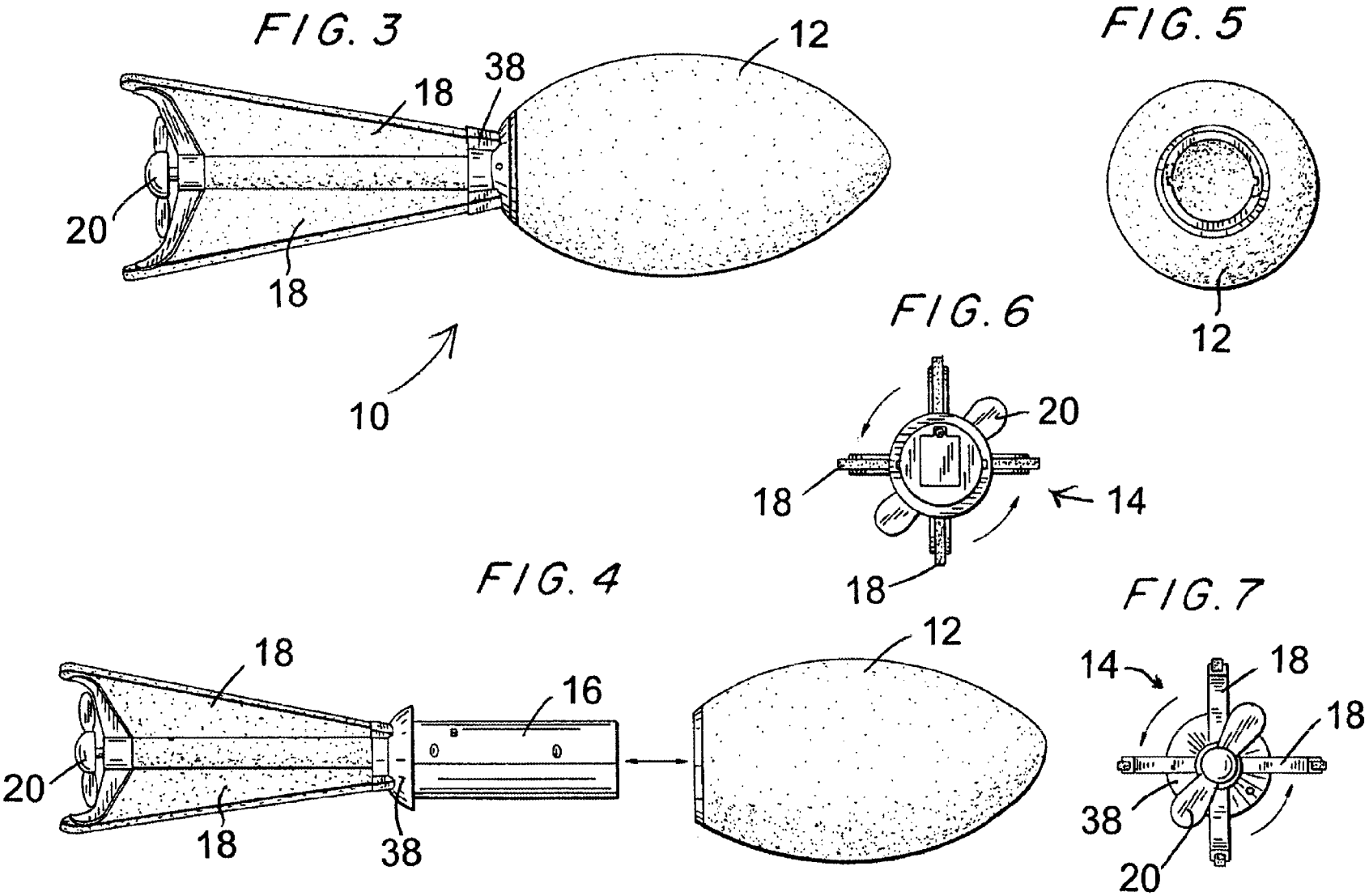
FIG. 3 is a side elevation view of such toy football.
FIG. 4 is an exploded side elevation view of said toy football.
FIG. 5 is a rear view of the front part of said toy football, i.e. that part shown in the right hand portion of FIG. 4.
FIG. 6 is a view looking rearwardly of that portion of the football shown in the left-hand side of FIG. 4.
FIG. 7 is a rear end view of said exploded portion of FIG. 4.

FIG. 1 is a perspective view of a propeller enhanced football 10 according to a first embodiment of the present invention; and comprises a football shaped, soft front body portion 12 formed of foamed rubber or foamed plastic, preferably with a smooth outer skin, and a rear module 14 comprising a housing 16 which normally fits and is retained within the front body portion 12, and which has a plurality of fins 18 extending rearwardly therefrom, as well as a propeller 20 at or adjacent the rear end thereof.

Figure 8:
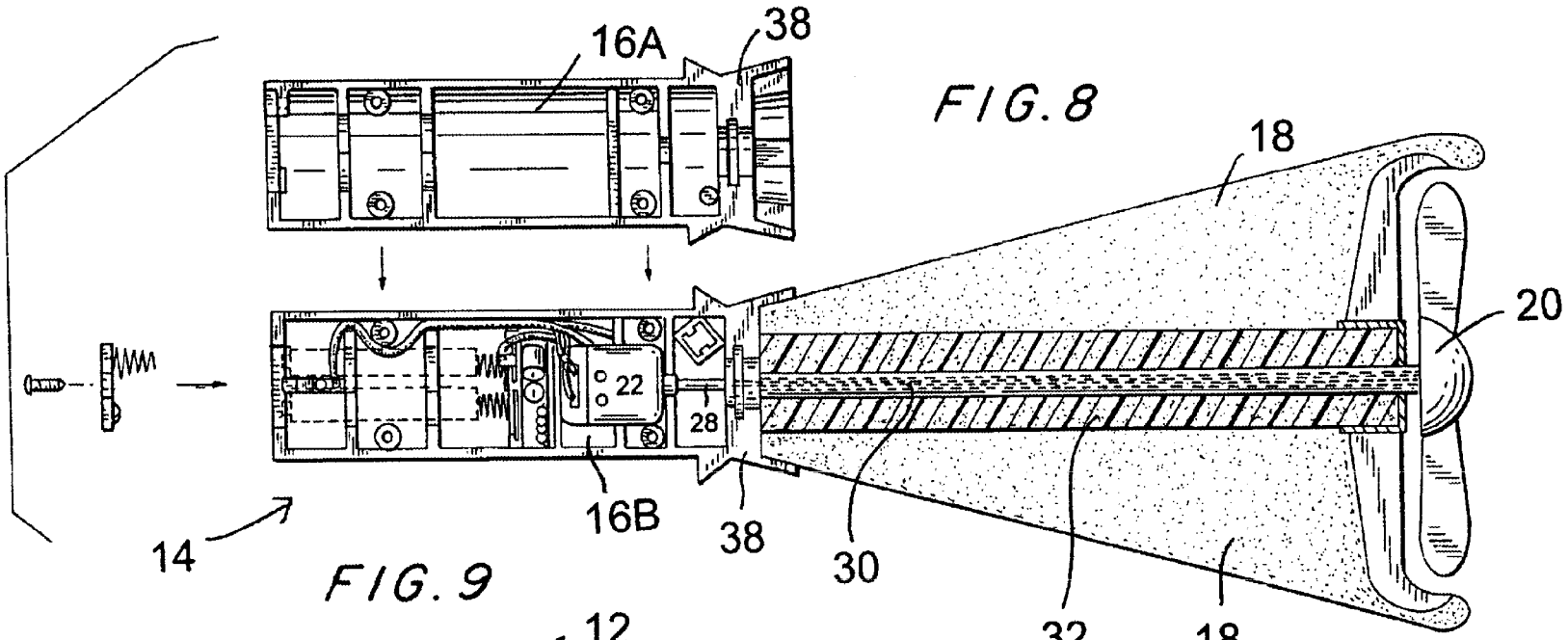
FIG. 8 is an exploded and sectional view of said rear portion.
Figure 10:
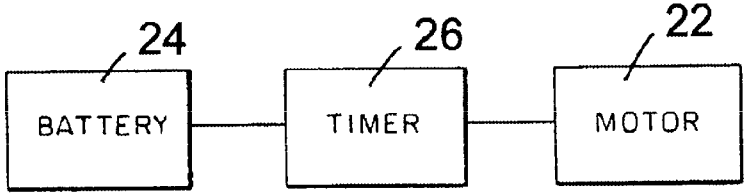
FIG. 10 is a schematic view of the electrical circuitry.

As shown in FIG. 8, the housing desirably is provided in two halves 16A and 16B, for easy access to the interior thereof which houses a small electric motor 22 wired to one or more batteries 24 through a timer 26. Extending from the motor 22 is a shaft 28. Either such shaft 28 itself or an extension 30 therefrom extends through a soft core 32 to which the fins 18 are connected or are made a part thereof. The shaft 28, 30 then extends back out through the end of the core 32 and its distal end is connected to the propeller 20.

Figure 9:
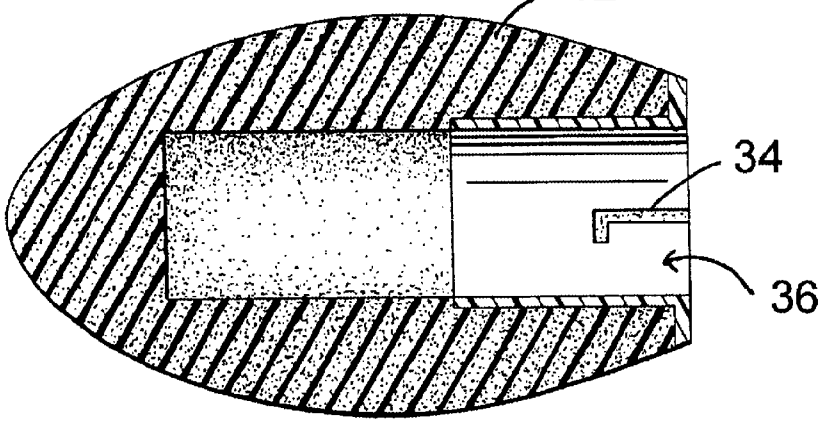
FIG. 9 is a sectional view of the front portion.

The body portion 12 and the rear module 14 are desirably locked together such as by a bayonet connection including a slot 34 as shown in FIG. 9. Thus, the rear module 14, after insertion of the battery or batteries into the housing 16, is easily assembled with the front body portion 12 by merely sticking the housing 16 into the elongated cavity 36 within the front body portion 12 and twisting to engage the bayonet locking mechanism including the bayonet slot 34. Where such a bayonet type locking mechanism is used, it will be understood that the housing 16 will carry a projection on its outer surface which will slide within the bayonet slot 34.

The exterior parts of the propeller enhanced football 10 of the present invention are preferably made of soft materials, most preferably soft foam rubber or soft foam plastic, these parts including the exterior and bulk of the front body portion 12, the fins 18 and the core 32. The blades of the propeller are desirably thin, soft and flexible, e.g. made of flexible plastic, so as to not cause any injury to the players which may include small children. One portion of the propeller-enhanced football 10 of the present invention which is made of a harder material is the housing 16 and its contents, and also the collar portion 38.

Mounted on the collar portion is a switch button which closes the circuit between the battery 24 and the motor 22. The timer can be set to open the circuit after any pre-selected time, preferably between five and ten seconds, although it will be understood that any reasonably short time can be pre-selected for the timer, e.g. seven seconds, ten seconds, fifteen seconds, etc.

In use, the person throwing the propeller-enhanced football will press the starter button causing the propeller to spin, and will then throw the football 10. The propeller will give the football 10 some enhanced thrust, increasing the distance the ball can be thrown and improving its stability in flight. After a predetermined time, e.g. seven seconds, the timer will break the circuit so as to turn the motor off.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A propeller enhanced play football comprising a front portion and a rear portion, said front portion having a substantially football-shape of soft and compressible material, said rear portion comprising a plurality of rearwardly projecting fins of soft material, said fins extending axially and radially, and a propeller at or near the back end of said fins, said propeller being rotationally mounted on an axially extending motor shaft, and a motor for driving said shaft and said propeller.

2. The propeller enhanced play football of claim 1 wherein said motor is an electric motor and is mounted within said front portion.

3. The propeller enhanced football of claim 1 wherein said propeller comprises blades formed of a soft and flexible material.

4. The propeller enhanced play football of claim 1 comprising a timer whereby said motor, after activation, will automatically turn off after a predetermined time.

5. The propeller enhanced football of claim 2 wherein said propeller comprises blades formed of a soft and flexible material.

6. The propeller enhanced play football of claim 5 comprising a timer whereby said motor, after activation, will automatically turn off after a predetermined time.

7. The propeller enhanced play football of claim 3 comprising a timer whereby said motor, after activation, will automatically turn off after a predetermined time.

* * * * *